US006187168B1

(12) United States Patent
LaCamera et al.

(10) Patent No.: US 6,187,168 B1
(45) Date of Patent: Feb. 13, 2001

(54) ELECTROLYSIS IN A CELL HAVING A SOLID OXIDE ION CONDUCTOR

(75) Inventors: Alfred F. LaCamera, Trafford; Siba P. Ray, Murrysville, both of PA (US)

(73) Assignee: Aluminum Company of America, Pittsburgh, PA (US)

( * ) Notice: Under 35 U.S.C. 154(b), the term of this patent shall be extended for 0 days.

(21) Appl. No.: 09/166,975

(22) Filed: Oct. 6, 1998

(51) Int. Cl.[7] ..... C25C 3/00; C25C 3/08; C25C 3/22

(52) U.S. Cl. ..... 205/367; 205/372; 205/377; 205/378; 205/384; 205/391; 204/243.1; 204/247.3; 204/290 R; 204/291; 204/292; 204/294

(58) Field of Search ..... 204/244, 243.1, 204/292, 293, 294, 291, 290 R, 247.3; 205/367, 369, 372, 377, 400, 405, 407, 404, 409, 410, 384, 378, 391

(56) References Cited

U.S. PATENT DOCUMENTS

| | | | | |
|---|---|---|---|---|
| 2,915,442 | | 12/1959 | Lewis | 204/67 |
| 2,915,443 | | 12/1959 | Wallace et al. | 204/67 |
| 3,562,135 | | 2/1971 | Marincek | 204/243 |
| 3,692,645 | | 9/1972 | Marincek | 204/67 |
| 3,960,678 | * | 6/1976 | Alder | 205/384 |
| 4,039,401 | * | 8/1977 | Yamada et al. | 205/384 |
| 4,595,466 | * | 6/1986 | Josefowicz | 205/394 X |
| 5,378,325 | | 1/1995 | Dastolfo, Jr. et al. | 204/66 |
| 5,415,742 | * | 5/1995 | LaCamera et al. | 204/244 X |

* cited by examiner

*Primary Examiner*—Donald R. Valentine
(74) *Attorney, Agent, or Firm*—Glenn E. Klepac

(57) ABSTRACT

An electrolytic cell and electrolytic process for producing a metal by reduction of a metal oxide dissolved in a molten salt bath containing at least one chloride and at least one fluoride. A solid conductor of oxide ions is interposed between the anode and the cathode. The solid conductor preferably comprises zirconia, stabilized in cubic form by addition of a divalent or trivalent metal oxide such as yttria.

17 Claims, 2 Drawing Sheets

ELECTROLYSIS IN A CELL HAVING A SOLID OXIDE ION CONDUCTOR

FIELD OF THE INVENTION

The present invention relates to electrolysis of a metal oxide dissolved in a molten salt bath wherein a solid oxide ion conductor separates the anode from the bath. More specifically the invention relates to production of aluminum from alumina dissolved in a fluoride-chloride molten salt bath.

BACKGROUND OF THE INVENTION

Processes for making aluminum by electrolysis of alumina dissolved in a molten salt bath are known in the prior art. Electrolytic processes in commercial use today for making aluminum involve passage of an electric current between a cathode and an anode in molten salt baths containing cryolite or other fluoride salts. The aluminum and sodium fluorides predominate, and lesser amounts of potassium, lithium, calcium, and magnesium fluorides may also be included.

In order to reduce the consumption of anode material in conventional electrolysis cells containing alumina-cryolite mixtures, Marincek U.S. Pat. Nos. 3,562,135 and 3,692,645 proposed a layer of oxygen-ion-conducting material in direct electrical contact with the anode. The oxygen-ion-conducting material is preferably zirconium oxide stabilized in a fluorite lattice by addition of calcium oxide, magnesium oxide, or yttrium oxide. However, stabilized zirconium oxide dissolves in molten cryolite and cells of Marincek's design are not in commercial use today.

In order to reduce the operating temperatures of aluminum electrolysis cells, prior art inventors have proposed molten salt baths containing various mixtures of fluoride and chloride salts. Two issued patents disclosing molten salt baths containing both fluoride and chloride salts are Lewis U.S. Pat. No. 2,915,442 and Wallace et al U.S. Pat. No. 2,915,443.

One important advantage of cells operated with mixed fluoride and chloride electrolytes is a lower bath density of about 1.74 g/cm$^3$ compared with about 2.2 g/cm$^3$ in cryolite baths. This lower density improves the stability of the bath-metal interface and allows an opportunity for a reduced interpolar distance, thereby improving cell productivity. Another advantage is reduced operating temperature, thereby enabling the use of materials that eliminate any need for a frozen layer of bath surrounding the cell top and sides. Reducing the cell temperature also reduces metal solubility in the bath, thereby improving current efficiency. Additionally, the chloride-fluoride bath electrical conductivity is higher than in conventional fluoride baths, effectively reducing resistive losses and improving current efficiency.

Reduced operating temperatures also lower sodium solubility, thereby minimizing distortion of the cathode blocks and improving overall dimensional stability of the interior lining. Reduced temperatures also extend cell life by reducing formation of aluminum carbide and its erosive effect on the cell block.

In spite of the advantages of mixed fluoride and chloride electrolytes, they are not used commercially. One concern about such electrolytes is the potential for producing chlorofluorocarbon compounds at the cell anode.

A principal objective of the present invention is to provide a process for production of metals by electrolysis in a molten salt bath, wherein the production of chlorofluorocarbon compounds as a by-product of the process is avoided by interposing a solid oxide ion conductor between the molten salt bath and the anode.

A further objective of the invention is to provide a process for production of metals by electrolysis in a molten salt bath, wherein the process can be retrofitted to existing electrolysis cells.

A related objective of the invention is to provide a novel electrolysis cell for carrying out the process of the invention.

One important advantage of our invention is that a mixed fluoride-chloride molten salt bath enables cell operation at a lower temperature than with all fluoride molten salt baths. Lower temperature operation reduces corrosion on the solid conductor of oxide ions, and enables operation at higher current densities without forming a crust on the cathode. Lower temperature and increased current density in a conventional, all fluoride molten salt bath precipitates sodium at the cathode thereby increasing voltage drop so that the cell eventually loses its ability to pass current.

Additional objectives and advantages of the present invention will become readily apparent to persons skilled in the art, from the following detailed description.

SUMMARY OF THE INVENTION

The potential for producing chlorofluorocarbon compounds in an electrolysis cell can be reduced or even eliminated entirely by separating the fluoride-chloride molten salt bath from the anode by a solid conductor of oxide ions. The solid conductor is preferably zirconia stabilized in cubic form by a divalent or trivalent metal oxide.

In accordance with the present invention, there is provided a cell for electrolyzing a metal oxide to make a metal. The metal oxide may be selected from the group consisting of aluminum oxide, magnesium oxide, silicon dioxide, titanium dioxide, lithium oxide, lead oxide, and zinc oxide in order to produce aluminum, iron, magnesium, silicon, titanium, lithium, lead, and zinc, respectively. Other metals may also be recovered, as will be appreciated by those skilled in the art. The metal oxide is preferably aluminum oxide, for production of aluminum.

The electrolytic cell of the invention includes an anode, a cathode, a molten salt bath, and a solid conductor of oxide ions between the anode and the cathode.

The anode may be made from a cermet such as a sintered combination of iron and nickel oxides with copper and silver. The anode material is preferably an inert substance that produces oxygen. Alternatively, the anode material is a carbonaceous substance that produces a carbon oxide, namely, carbon dioxide and/or carbon monoxide. The carbonaceous material may be prebaked carbon produced by molding petroleum coke and coal tar pitch, and then baking at 1000–1200° C.

The cathode may be made from a refractory hard metal (RHM), carbonaceous material coated with an RHM such as titanium diboride, or a carbonaceous material. As used herein, the term "refractory hard metal" refers to the borides, carbides, and nitrides of titanium, zirconium, and hafnium. The cathode is preferably wetted by aluminum which can be achieved by using a wettable material or a coating wettable to aluminum. Less preferably, the cathode may be a carbonaceous material such as prebaked carbon produced by molding a mixture of petroleum coke and coal tar pitch, and then baking at 1000–1200° C.

The molten salt bath contains an oxide of the metal to be produced, together with at least two salts selected from cryolite ($Na_3AlF_6$), the chlorides of sodium and potassium, and the fluorides of sodium, aluminum, and potassium. The molten salt bath may also contain other chlorides and fluorides in lesser amounts, including LiCl, $MgCl_2$, $CaCl_2$, LiF, $MgF_2$, and $CaF_2$. The oxide may be an oxide of aluminum, magnesium, zinc, silicon, titanium, lithium, or lead, and is preferably alumina ($Al_2O_3$).

The molten salt bath may contain about 30–90 wt. % chlorides and about 10–70 wt. % fluorides. In a preferred embodiment, the molten salt bath comprises about 15–35 wt. % NaCl, 25–45 wt. % KCl, and 30–50 wt. % cryolite.

The solid conductor has a molecular framework structure permitting oxide ions to move from the salt bath to the anode, without exposing the anode to fluorides and chlorides in the molten salt bath. The solid conductor may be zirconia, ceria or hafnia, and is preferably zirconia stabilized in cubic form by a divalent or trivalent metal oxide. Some suitable divalent and trivalent oxides include MgO, NiO, SrO, CaO, $Y_2O_3$, $Sc_2O_3$, $La_2O_3$, $Gd_2O_3$ and $Ce_2O_3$.

The solid conductor may be applied as a layer, coating or film on the anode or it may be a thin membrane laminated to the anode. A preferred solid conductor is connected electrically with the anode and has a thickness of less than about 1 mm.

DETAILED DESCRIPTION OF PREFELTED EMBODIMENTS

Figure 1:
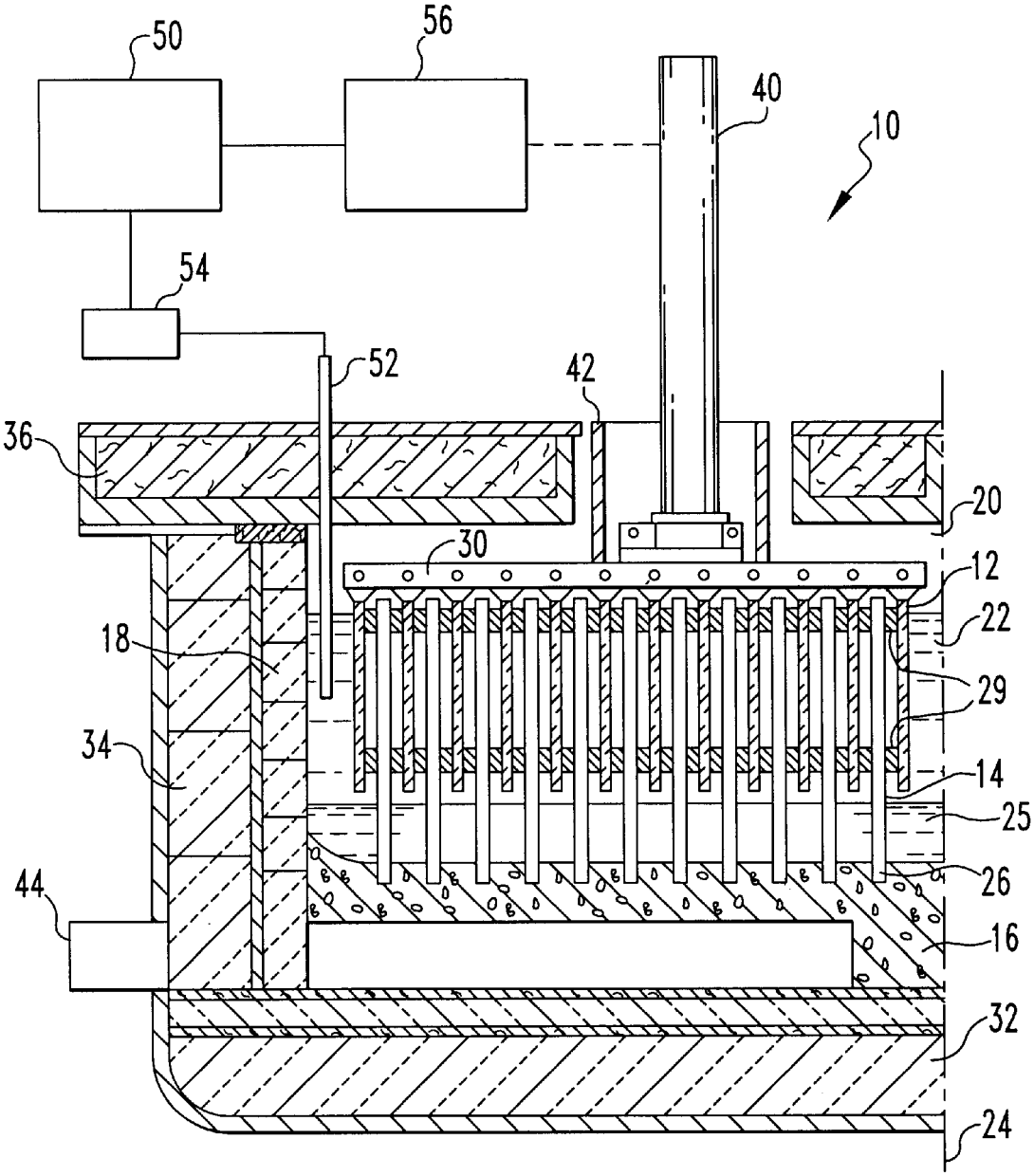
FIG. 1 is a schematic cross-sectional view of an electrolysis cell for producing a metal by reduction of a metal oxide, in accordance with the present invention.

An electrolytic cell 10 for producing aluminum or other metal in accordance with the present invention is shown in FIG. 1. The cell 10 includes several anodes 12 and cathodes 14, all arranged in an interleaved, vertical array. A carbonaceous, electrically conductive floor 16 and a side wall 18 define a chamber 20 containing a molten salt bath 22. Only half of the cell 10 is shown left of a centerline 24.

A molten aluminum cathode pad 25 rests on the floor 16, touching the cathodes 14. As shown in FIG. 1, the cathodes 14 extend upwardly from slots 26 defined by the floor 16. The cathodes 14 are spaced from the anodes 12 by suitable electrical insulators 29. Alternatively, the cathodes 14 may be suspended from the anode assembly 30.

Thermal insulation is provided by a bottom lining 32 below the floor 16, a side lining 34 outside the side wall 18, and an insulated lid 36. The linings 32, 34 and the lid 36 provide sufficient insulation for cell operation without a frozen crust adjacent the lid 36 and without any frozen bath adjacent the side wall 18.

A rod 40 functions as an anode collector bar for furnishing direct electrical current to the anodes 12. A sleeve 42 protects the connection between the anode collector bar 40 and the anodes 12 from attack by molten salts. A cathode collector bar 44 removes current from the cell.

Heat control for the cell 10 is based on a digital computer 50. A temperature sensor, preferably a thermocouple 52, supplies a temperature-indicative signal to a signal converter 54 interfaced with the computer 50. The computer 50 in turn controls a vertical position adjuster 56 connected with the anode rod 40 and the anodes 12.

The anode 12 comprises a cermet made by sintering nickel oxide, iron oxide, and copper The cathode 14 is solid titanium diboride. The molten salt bath 22 comprises about 25 wt. % NaCl, 35 wt. % KCl, and 40 wt. % cryolite. About 2–4 wt. % alumina is dissolved in the bath.

Figure 2:
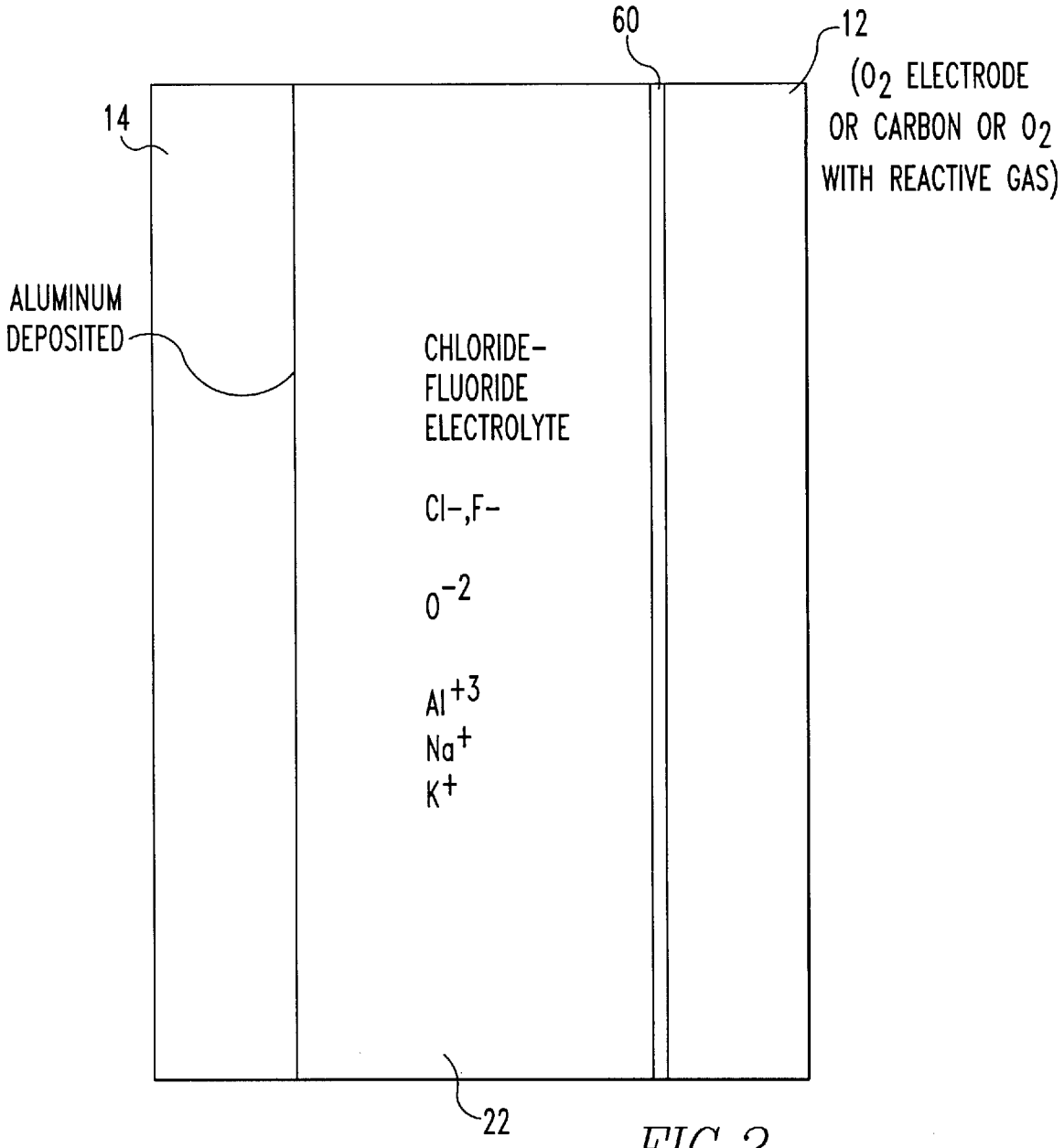
FIG. 2 is an enlarged, fragmentary, cross-sectional view of the electrolysis cell of FIG. 1.

Referring now to FIG. 2, there is shown an anode 12 and a cathode 14, separated by molten salt bath 22. When the cell 10 is in operation, aluminum is deposited at the cathode 14 and oxygen evolves at the anode 12.

In order to minimize production of chlorofluorocarbons at the anode 12, we provide a solid conductor of oxide ions 60 between the anode 12 and the molten bath 22. The solid conductor 60 has a molecular framework structure permitting oxygen ions to pass from the bath 22 to the anode 12. The solid conductor 60 also prevents the bath 22 from contacting the anode 12, thereby avoiding chemical reaction between carbon in the anode 12 and fluorides and chlorides in the bath 22.

The solid conductor 60 may be provided as a layer or sheet electrically connected to the anode 12 and forming a barrier between the anode 12 and the bath 22, as shown in FIG. 2. The solid conductor layer 60 has a thickness of less than about 0.1 mm. Alternatively, the solid conductor 60 may comprise a coating or film on the anode 12.

The solid conductor 60 preferably comprises zirconia ($ZrO_2$) stabilized by addition of yttria ($Y_2O_3$). Alternatively, the solid conductor may comprise predominately hafnia ($HfO_2$) or ceria ($CeO_2$) doped with one or more divalent or trivalent metal oxides. The suitable solid conductors all have a fluorite crystal structure, thereby providing large amounts of oxygen vacancy when substituted with the aliovalent oxides. Accordingly, these crystals have high oxygen mobility and oxygen ion conduction.

Besides yttria, other suitable dopants for zirconia include CaO, MgO, SrO, NiO, $Sc_2O_3$, $La_2O_3$, $Ce_2O_3$, and $Gd_2O_3$. Other additives that may be included in the solid conductor are $Al_2O_3$ and $Fe_2O_3$. These oxides may provide other benefits, such as mixed conduction and lower overvoltage.

Having described the presently preferred embodiments, it is to be understood that the invention may be otherwise embodied within the spirit and scope of the appended claims.

What is claimed is:

1. A cell for producing a metal by electrolysis, comprising:

an anode, a cathode, a solid conductor of oxide ions interposed between the anode and cathode and comprising a molecular framework structure, and a molten salt bath contacting said cathode and said solid conductor, said bath containing an oxide of a metal and at least one fluoride selected from cryolite and fluorides of sodium and aluminum, and at least one chloride selected from chlorides of sodium and potassium.

2. The cell of claim 1 wherein said solid conductor comprises zirconia, ceria or hafnia.

3. The cell of claim 2 wherein said solid conductor comprises zirconia stabilized in cubic form.

4. The cell of claim 2 wherein said solid conductor is stabilized by a divalent or trivalent metal oxide.

5. The cell of claim 4 wherein said divalent or trivalent metal oxide is selected from the group consisting of MgO, SrO, CaO, $Y_2O_3$, $Sc_2O_3$, $La_2O_3$, $Gd_2O_3$, $Ce_2O_3$ and NiO.

6. The cell of claim 1 wherein said metal is selected from the group consisting of aluminum, magnesium, zinc, lithium, and lead.

7. The cell of claim 1 wherein said molten salt bath comprises cryolite, NaCl, and KCl.

8. The cell of claim 1 wherein said molten salt bath further comprises at least one chloride or fluoride selected from the group consisting of LiCl, $MgCl_2$, $CaCl_2$, LiF, $MgF_2$, and $CaF_2$.

9. The cell of claim 1 wherein said molten salt bath has a temperature of less than about 900° C.

10. The cell of claim 1 wherein said molten salt bath has a temperature of about 750°–900° C.

11. The cell of claim 1 wherein said anode comprises at least one material selected from carbonaceous material, cermets, and metals.

12. The cell of claim 1 wherein said cathode comprises at least one material selected from carbonaceous material, titanium diboride, and carbonaceous material coated with titanium diboride.

13. A process for producing a metal by electrolysis in a cell comprising an anode, a cathode a solid conductor of oxide ions between the anode and the cathode and comprising a molecular framework structure, and a molten salt bath contacting the cathode and the solid conductor and containing an oxide of a metal and at least one fluoride and at least one chloride, said process comprising:

passing an electric current between the cathode and the anode, and collecting a metal at said cathode.

14. The process of claim 13 further comprising:

passing oxide ions from said molten salt bath through said oxide ion conductor to said anode, and collecting oxygen or a carbon oxide at said anode.

15. The process of claim 13 wherein said oxide ion conductor comprises zirconia stabilized in cubic form.

16. The process of claim 13 wherein said molten salt bath comprises at least one fluoride selected from cryolite, sodium fluoride, and aluminum fluoride and at least one chloride selected from sodium chloride and potassium chloride.

17. In a process for producing aluminum by electrolysis in a cell comprising an anode, a cathode, a solid conductor of oxide ions between the anode and the cathode, and a molten salt bath contacting the cathode and the solid conductor, said process comprising passing an electric current between the cathode and the anode, the improvement wherein said molten salt bath comprises alumina dissolved in a mixture comprising at least one fluoride selected from cryolite and fluorides of sodium and aluminum and at least one chloride selected from chlorides of sodium and potassium.

* * * * *